US009103087B2

(12) United States Patent
Munro

(10) Patent No.: US 9,103,087 B2
(45) Date of Patent: Aug. 11, 2015

(54) METHOD OF REDUCING MUD IN AN ANIMAL STABLE, PEN, PADDOCK, OR ARENA

(71) Applicant: Lightfoot Geo Solutions LLC, Monroe, WA (US)

(72) Inventor: Daniel L. Munro, Monroe, WA (US)

(73) Assignee: Lightfoot Geo Solutions LLC, Monroe, WA (US)

( * ) Notice: Subject to any disclaimer, the term of this patent is extended or adjusted under 35 U.S.C. 154(b) by 0 days.

(21) Appl. No.: 13/801,654

(22) Filed: Mar. 13, 2013

(65) Prior Publication Data

US 2014/0270982 A1 Sep. 18, 2014

(51) Int. Cl.
*E02D 3/00* (2006.01)

(52) U.S. Cl.
CPC ..... *E02D 3/005* (2013.01)

(58) Field of Classification Search
CPC ..... E02D 3/005
USPC ..... 405/302.4, 302.6, 302.7
See application file for complete search history.

(56) References Cited

U.S. PATENT DOCUMENTS

| | | | | |
|---|---|---|---|---|
| 4,965,097 | A * | 10/1990 | Bach | 405/302.4 |
| 5,320,455 | A | 6/1994 | Mattox | |
| 6,296,924 | B1 * | 10/2001 | Bach | 405/302.7 |
| 6,554,545 | B1 * | 4/2003 | Hall | 405/302.4 |
| 7,993,080 | B2 * | 8/2011 | Erez et al. | 405/302.4 |
| 8,025,457 | B2 | 9/2011 | Halahmi et al. | |
| 8,173,241 | B2 * | 5/2012 | Halahmi et al. | 405/302.4 |
| 8,303,218 | B2 | 11/2012 | Erez et al. | |
| 8,425,158 | B2 * | 4/2013 | Milton et al. | 405/302.7 |
| 2009/0142542 | A1 * | 6/2009 | Halahmi et al. | 428/116 |
| 2010/0119766 | A1 * | 5/2010 | Senf et al. | 428/99 |

OTHER PUBLICATIONS

Stable Grid, "Keeps Livestock Out of the Mud", May 29, 2007.*
www.hoofgrid.com.
www.stable-grid.com.
www.equigym.com/Products/StableGrid/, (2010).

* cited by examiner

*Primary Examiner* — Frederick L Lagman
(74) *Attorney, Agent, or Firm* — Miller Nash Graham & Dunn LLP; Kathleen T. Petrich

(57) ABSTRACT

A system for and method of remediating existing mud and reducing future mud in an animal stable, pen, paddock, or arena through the use of geocells filled with aggregate matter. A new surface is formed through the placing of a layer of networked geocells filled with compacted aggregate matter on top of the existing stable, pen, paddock or arena ground soil. A geotextile barrier may be placed below the layer of networked geocells. An optional aggregate layer may also be added on top of the aggregate-filled geocells. The geocells distribute loads (weight from the animals) across the soil, preventing soil displacement and mud formation.

9 Claims, 9 Drawing Sheets

METHOD OF REDUCING MUD IN AN ANIMAL STABLE, PEN, PADDOCK, OR ARENA

TECHNICAL FIELD

The present invention relates generally to a method of remediating and preventing mud in an animal stable, pen, paddock, or arena through the use of geocells filled with aggregate matter. The geocells distribute loads applied to soil by hooves over larger surface areas, preventing soil displacement and subsequent mud formation.

BACKGROUND OF THE INVENTION

Horse, and other animal, farms often have problems preventing and managing mud formation in areas where the animals walk on soil. The presence of heavy animal traffic, rainfall, and manure on farms often coalesce into mud and remain so for all but the driest months of the year. Mud presence on farms poses a threat to the health of animals in several ways: mud is a vector for bacterial growth; hooves that stay wet for long periods of time can soften and rot causing immobility and pain; prolonged mud to skin contact can irritate skin and cause rashes, open sores, and infections; and animals may slip or misstep in mud increasing the risk of injuries.

Referring to prior art FIGS. 1-3, mud is created when animals traverse across wet soil (and manure) repeatedly. Mud is the result of displacement of saturated unstable soil from the pressure of an animal's hoof downward on a ground surface. The soil is displaced laterally creating instability and causing deep mud in situations where a soil's water-holding capacity creates an environment of moisture and instability. FIG. 1 discloses a typical animal paddock 2 where there is a build-up of wet soil 4 on ground 6. When a hooved animal, such as a horse 8, applies its weight to the wet soil 4 through its hooves 10, a downward force is applied from the hoof 10 as illustrated in FIG. 2. The downward force as the animal's hoof steps down onto the wet soil displaces the wet soil and makes the top 1-6" surface of the soil broken and uneven. Not only is the animal (horse) working harder to move about, but the pressure and displacement of the wet soil effectively destabilizes the ground and results in the formation of mud. Lateral soil displacement resulting from the downward force applied by a hoof (shod or unshod) 12 attached to the base of the animal's hoof 10 is illustrated schematically in FIG. 3. This process is sped up by more movement, bad weather, and more animals per area. The repeated displacement of the soil kills plants and roots and also mixes in water and organic matter, such as manure. Higher organic content in the soil increases the water holding capacity. These actions result in the creation and persistence of mud on animal farms. Within a matter of days, one active horse can turn a 24 ft by 40 ft typical paddock with wet soil into 3-6 inches of deep mud in high traffic areas.

The presence of mud also makes working on the farm difficult and can result in: difficulties removing manure; struck tractors and other equipment; and reduced access to sections of the farm.

SUMMARY OF THE INVENTION

The present invention is directed to an improved surface for and a method of remediating existing mud and preventing future mud in the areas where animals are kept, exercised, and allowed to move, such as stables, pens, paddocks, and arenas.

The method includes the creating of a new surface made from networked aggregate filled geocells, which are oftentimes used to stabilize various terrains. The new method and surface distribute weight of the animals relative to the new surface and stabilizes the ground by limiting the displacement of aggregate to within the individual geocells. Applying geocells in animal areas provides long term mud prevention by preventing the mixing action of the hooves in wet soil.

According to one aspect of the invention, a geotextile barrier, such as a fabric, is placed on top of the existing soil of the stable, pend, paddock, or arena. A layer of networked geocells may be placed on top of the geotextile barrier. The networked geocell layer consists of connected individual geocells having a sidewall or cell wall defining an opening, for example that is generally almond shaped. The geocell openings are filled with inorganic aggregate material, such as gravel or crushed rock, and are compacted within the networked geocell layer.

The networked geocell layer applied on top of the geotextile barrier separates the aggregate from the underlying soil, preventing upward propagation of mud or mixing of aggregate into the mud.

A layer of aggregate is placed atop of the filled and compacted networked geocell structure to create a firm upper surface. The aggregate surface on top of the cells creates an ideal surface for removing manure. Promoting good manure removal practices further reduces the chance of mud formation.

The firm surface provided by the geocells and the aggregate layer prevents mud related injuries and health conditions on farms.

Optional perforations may be added to the geocell cell walls to promote drainage and prevent surface pooling, which prevent mud formation on top of the cells.

Another benefit is that the new firm surface of the animal area (e.g., paddock) is much easier to maintain and keep clean.

These and other advantages will become more apparent upon review of the Drawings, the Detailed Description of the Invention, and the Claims.

BRIEF DESCRIPTION OF THE DRAWINGS

Like reference numerals are used to designate like parts throughout the several views of the drawings, wherein.

DETAILED DESCRIPTION OF THE INVENTION

Figure 1:
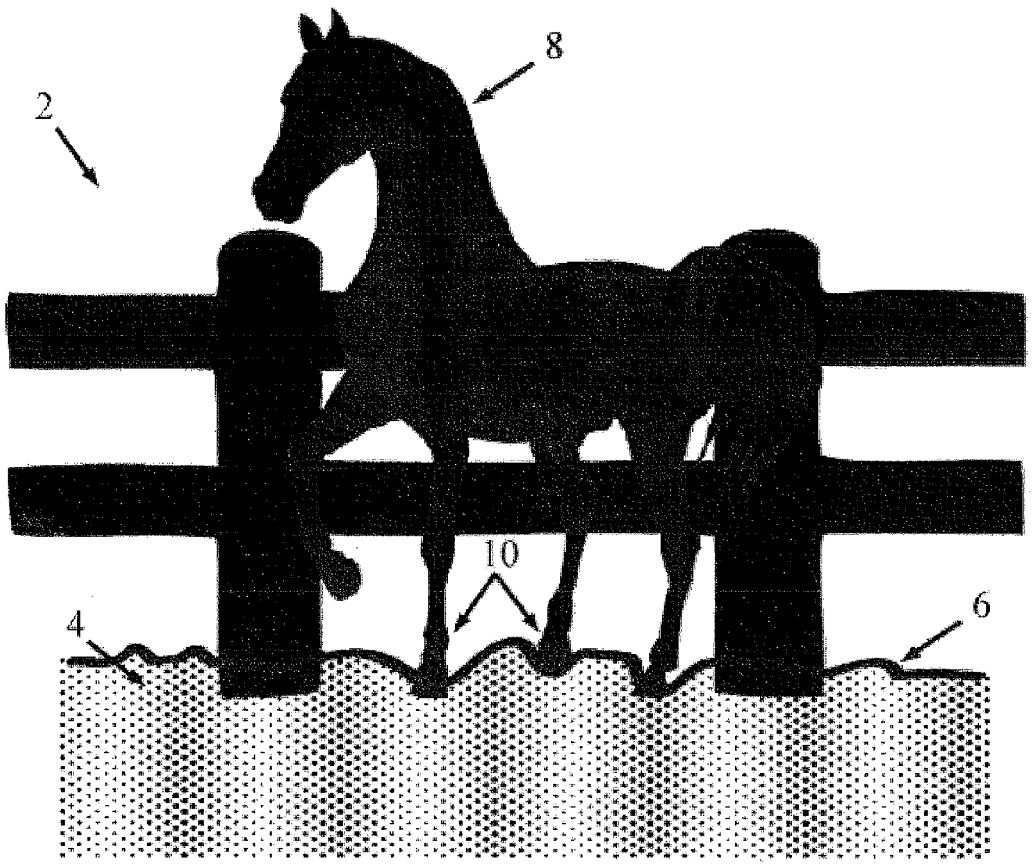
FIG. 1 is a prior art schematic view of an animal paddock for a farm animal with hooves, such as a horse, in an area with wet soil and mud where the horse sinks into unstable soil as illustrated by a broken and uneven ground surface.

The present invention is directed to a new surface for and method to prevent mud in animal stables, pens, paddocks, and arenas through the use of geocells. Referring to FIGS. 4-9, a new surface is Created of networked and aggregate-filled geocells 20. The new surface is placed on top of soil 22 of the ground where animals 24, such as horses and other farm animals, are kept and exercised.

Geocells 20 are known for their application for earth stabilization for retaining walls and the like. Geocells are a network of flexible individual geocells 26, where each geocell defines an opening. According to one aspect of the present surface and method, the networked geocells 26 are generally almond-shaped having two end points 28 and mid-section points 30 that are adhered (e.g., welded) to adjacent geocells at respective end points and mid-section points. However, other geocell shapes are envisioned. Each geocell has a cell wall or sidewall 32 that defines opening 34. The overall geocell network recalls a flexible honeycomb structure defining an upper surface and a lower surface. Geocell cell walls are approximately 3 to 8 inches in height and having a cell width of approximately 5-10 inches. Geocells are generally made from a man-made material (e.g., plastic) and can be obtained from manufacturers, such as those manufactured by Geo Products, L.L.C. of Houston, Tex. under the ENVIROGRID trademark or Presto Geosystems of Appleton, Wis. sold under the PRESTO GEOSYSTEMS brand.

The surface and method of the present invention may include a geotextile barrier 36 that is placed on top of the existing soil 22 in the animal stable, pen, paddock, or arena. The geotextile barrier may be a non-woven geotextile (e.g., a fabric) that may be like that obtained from U.S. Fabrics and sold under the product name (trademark) COW CARPET.

A geocell layer 20, as described above, is then placed atop of the geotextile barrier 36. The openings 34 of the individual geocells 26 are filled with an angular aggregate material 38, such as gravel or crushed rock, which is then compacted into the geocells through any traditional compacting method (e.g., plate compactor or tractor). An optional additional layer of aggregate 40 may be added on top of the upper surface of the geocell layer. The top layer of aggregate can be in the range of ½ to 4 inches.

Figure 2:
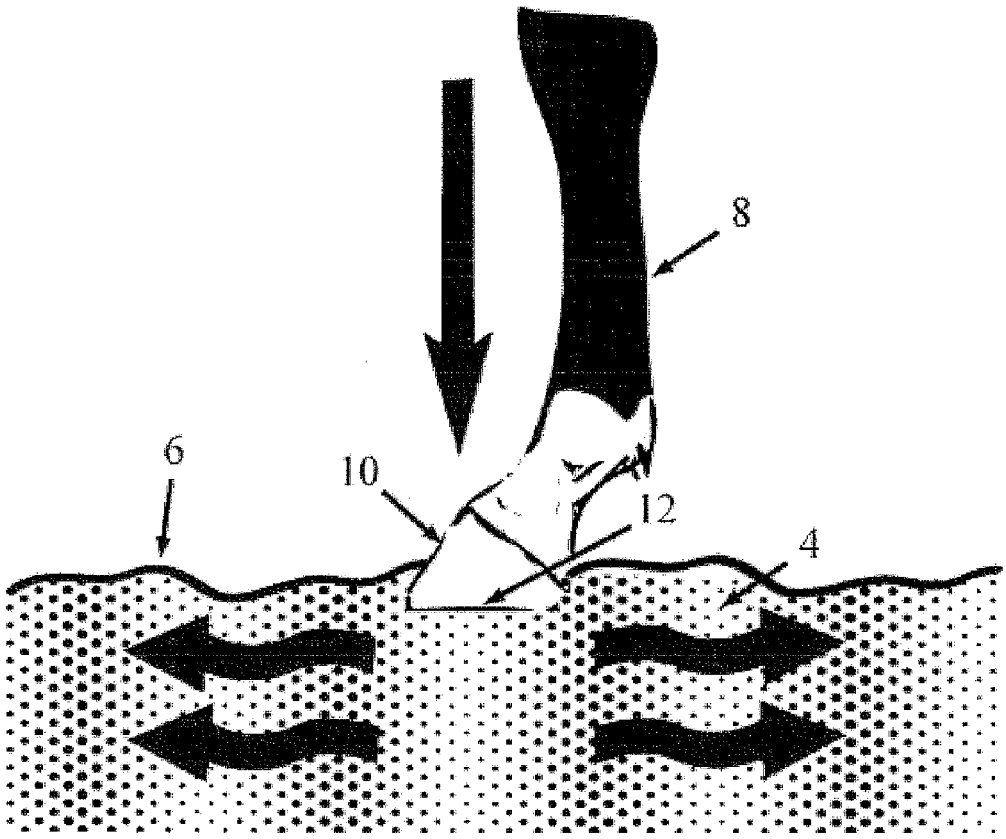
FIG. 2 is an enlarged schematic view of a horse hoof of FIG. 1 displacing wet soil and churning it into mud through the downward and resulting lateral force and displacement of the wet soil due to the animal's weight.
Figure 3:
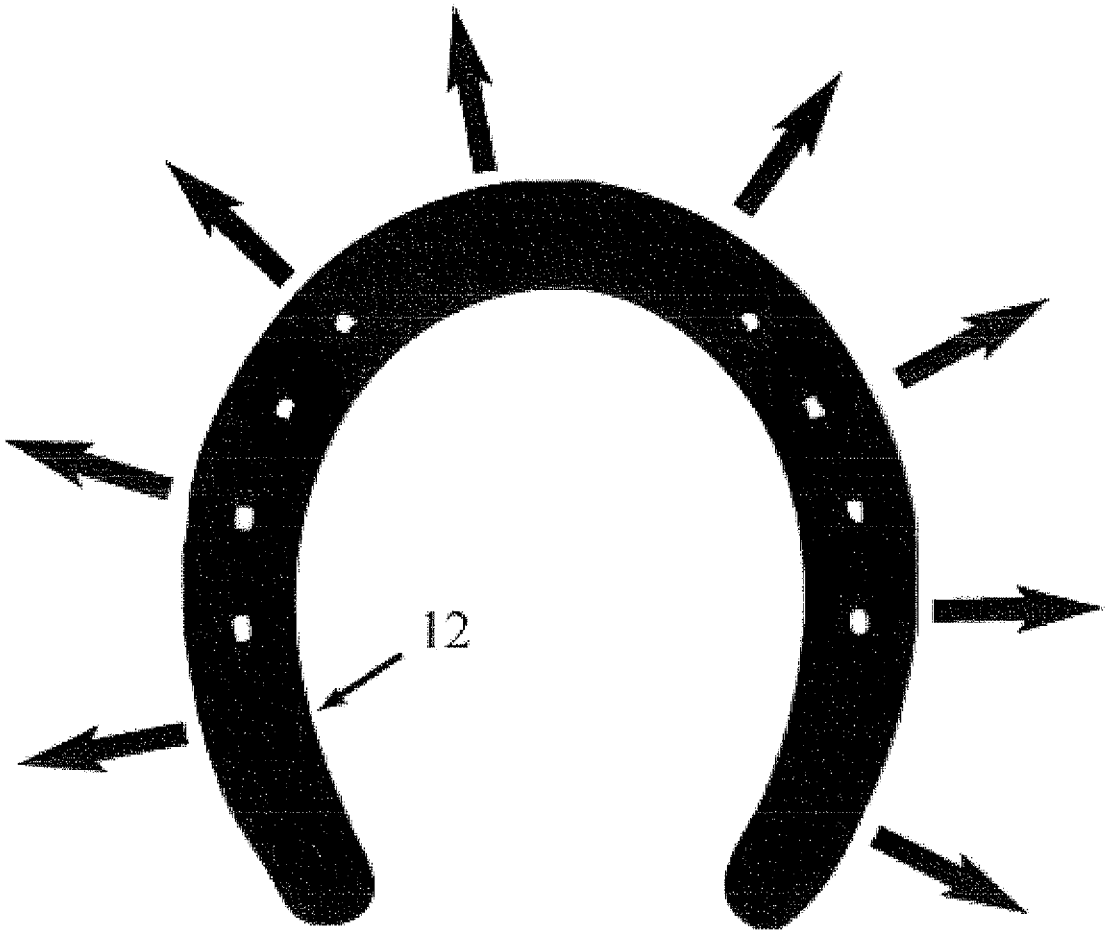
FIG. 3 is a perspective view of the lateral soil displacement resulting from the downward force applied by the base of horse hoof of FIG. 2 depicted by a horseshoe shape.
Figure 4:
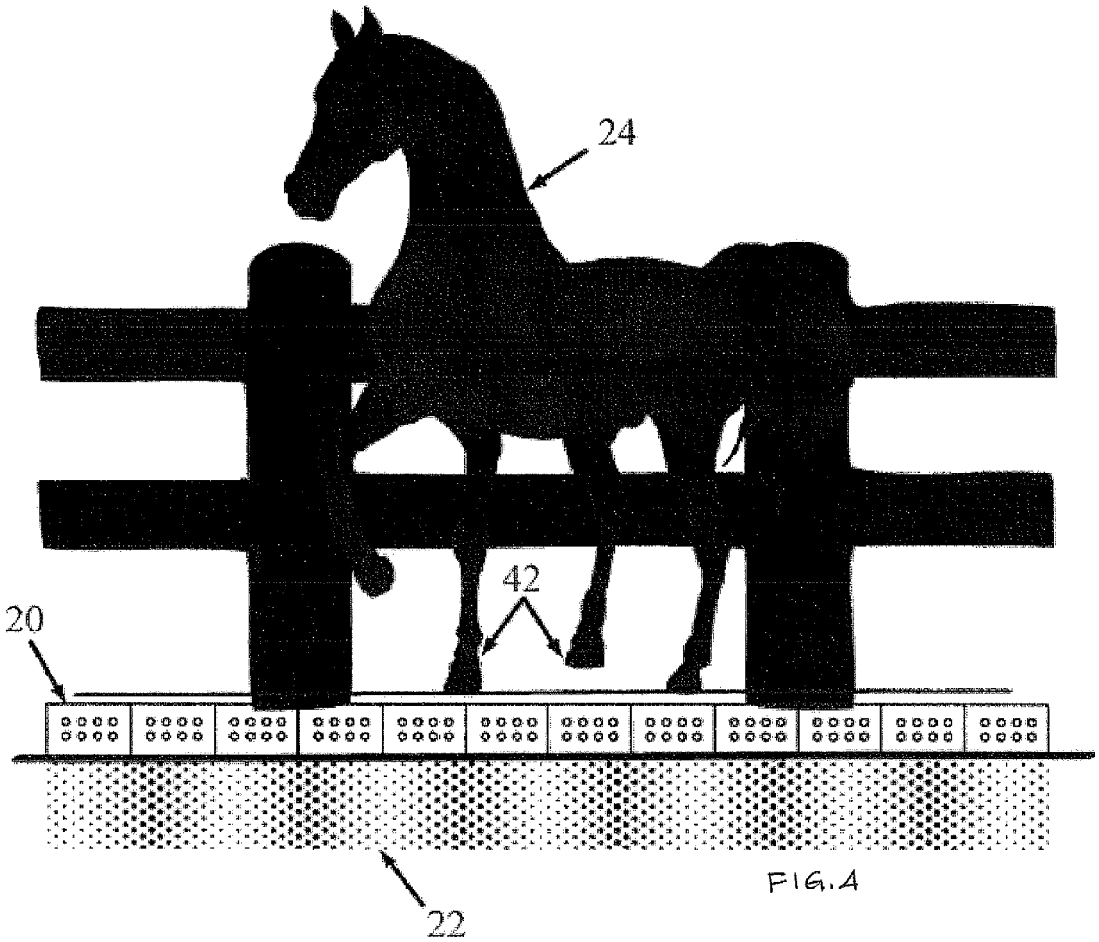
FIG. 4 is a schematic view of a horse paddock similar to the one in prior art FIG. 1, except that a geocell layer and crushed aggregate and a geotextile barrier of the present invention is illustrated on top of the soil and mud on the ground such that the horse's weight is distributed across a generally unbroken surface and the mixing action is no longer present preventing the formation of mud.
Figure 5:
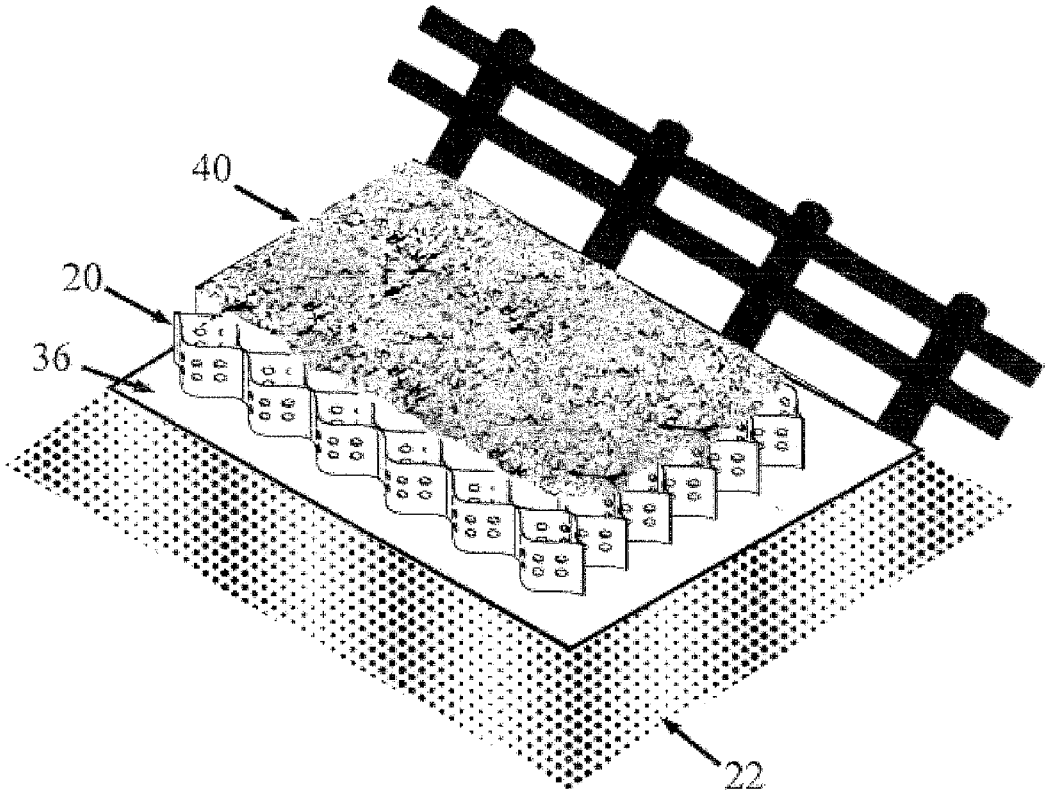
FIG. 5 is a schematic view illustrating the various layers: aggregate, geocell layer, and geotextile barrier all laid atop of the soil in the paddock, stable, pen, or arena.
Figure 6:
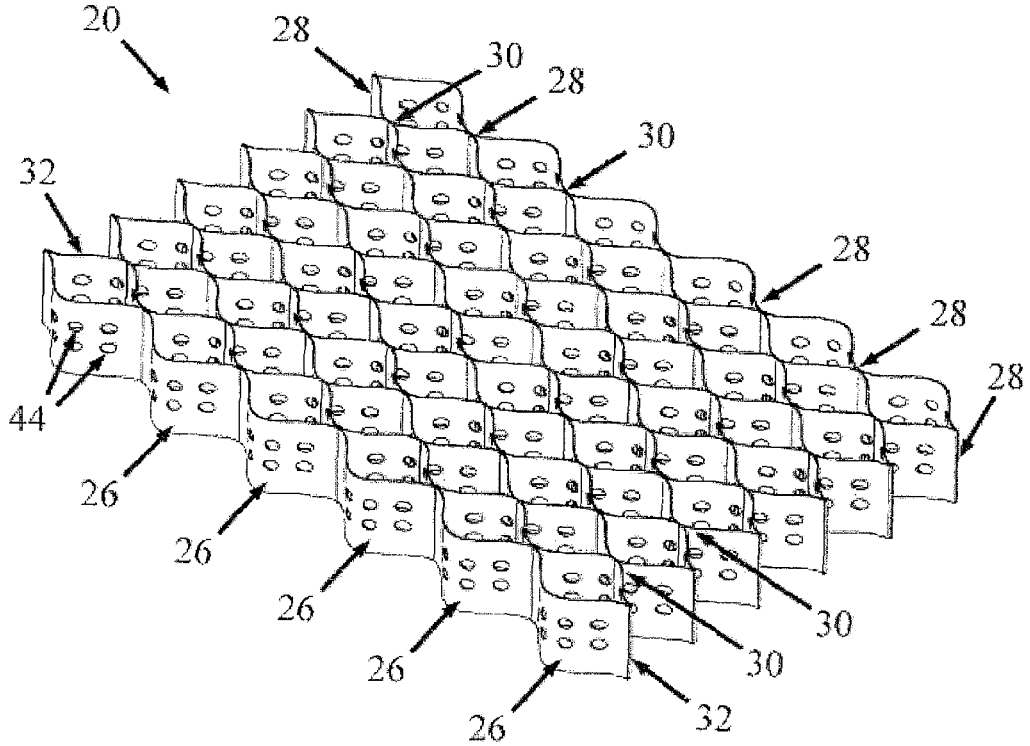
FIG. 6 is a perspective view of a known geocell layer used in the method of FIGS. 4 and 5, the geocell layer consists of a network of flexible and generally almond-shaped cells that are adhered at endpoints and midpoints of adjacent cells.
Figure 7:
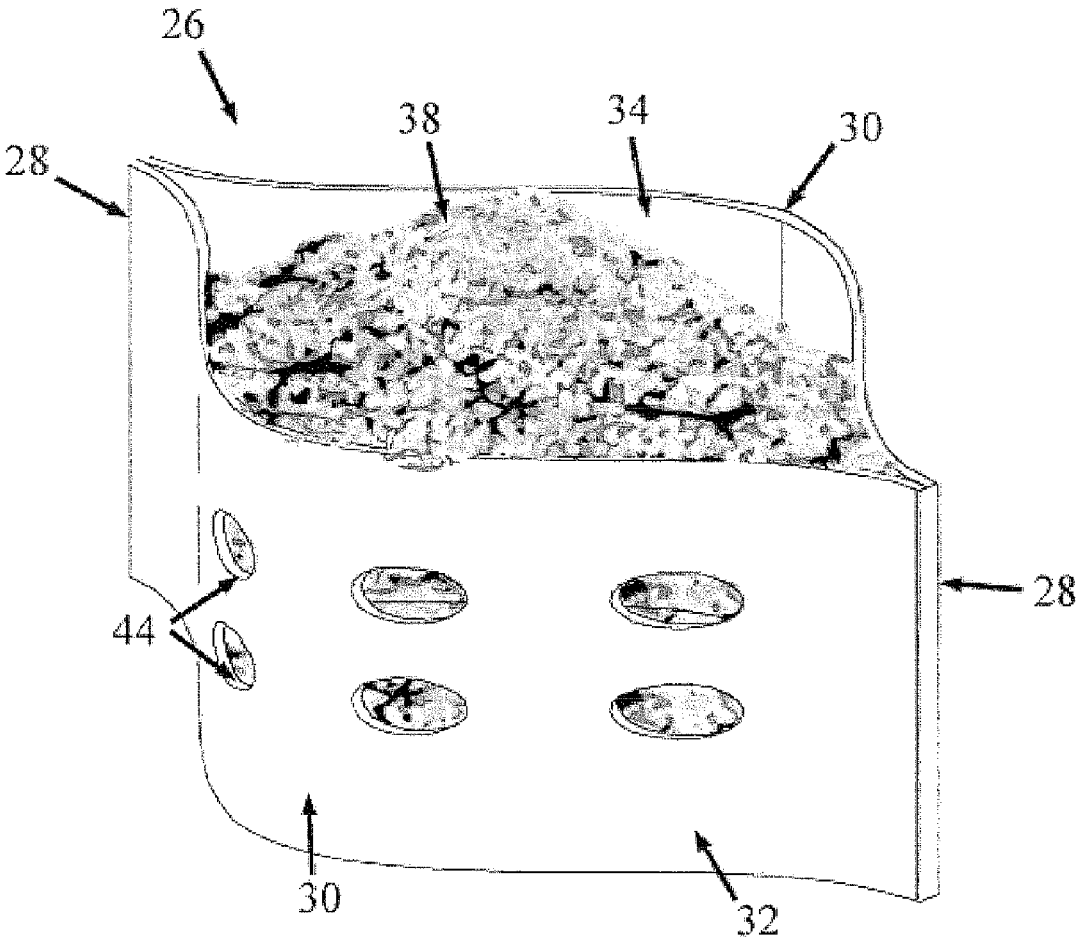
FIG. 7 is an enlarged perspective view of a single geocell of FIG. 6 where each geocell unit has a flexible sidewall that defines an opening, e.g., an individual generally-almond shaped opening, which is filled with an aggregate material as illustrated; the cell sidewall is further illustrated with optional perforations through the sidewall
Figure 8:
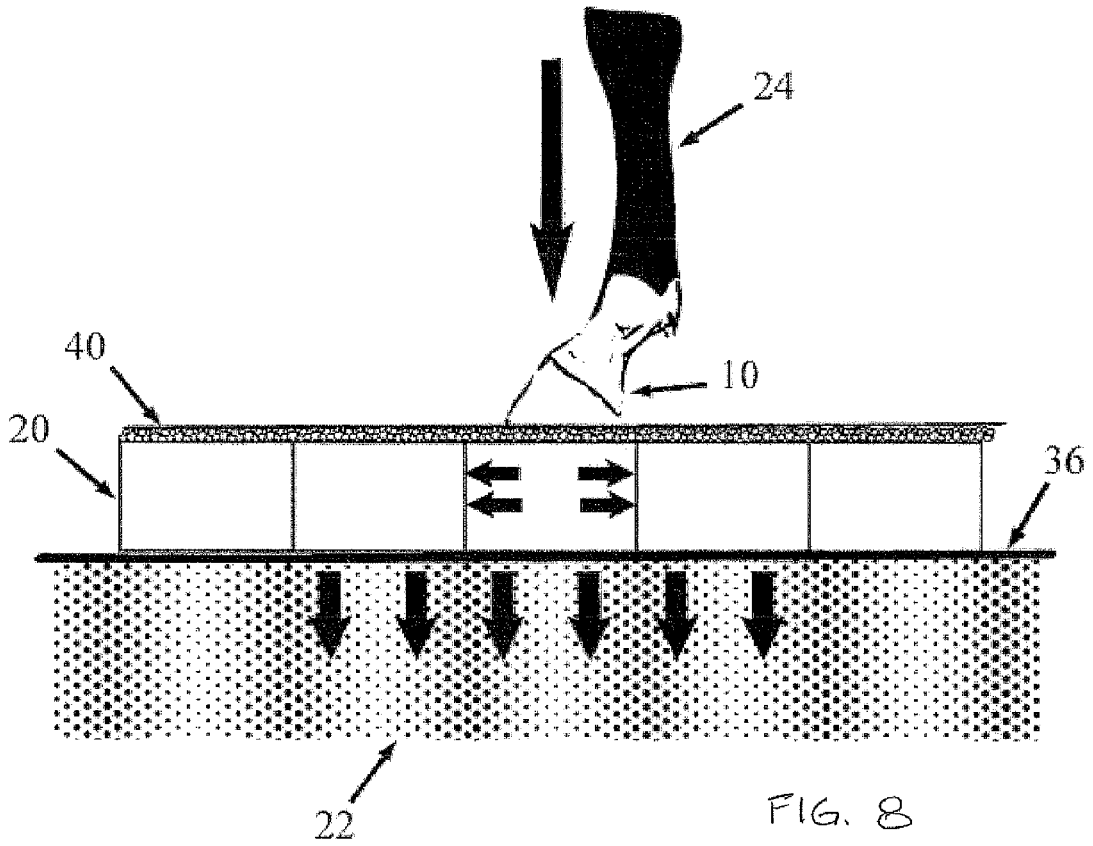
FIG. 8 is a schematic view illustrating how an animal hoof applies a downward force on the geocell and aggregate layer atop of the existing soil and how this force is distributed over a larger surface area at the geocell/soil junction.

The geocell and aggregate construct distribute loads applied to the surface FIG. 8 across a larger surface area, rather than the point of ground contact as illustrated in FIG. 2. An animal hoof 42 applies a high pressure to the surface due to its relatively small surface area. The aggregate-filled geocells limit the displacement of inorganic material, which is also prevented from eroding or migrating by the limiting action of the geocells. The aggregate-filled geocells further limit mixing with any mud below the geocells by means of the geotextile barrier. The geocell construct translates this load to the ground over a larger surface area. Because the aggregate (inorganic) layer on the surface is supported by the cell walls of the geocell structure, the inorganic layer does not become unstable and provides a solid surface for the animal (horse) to move or stand on (effectively controlling the distribution of weight and pressure of the animal(s) onto the surface). This controlling of distribution of weight and pressure prevents the hooves from punching into wet soil and the mixing action that causes mud.

Figure 9:
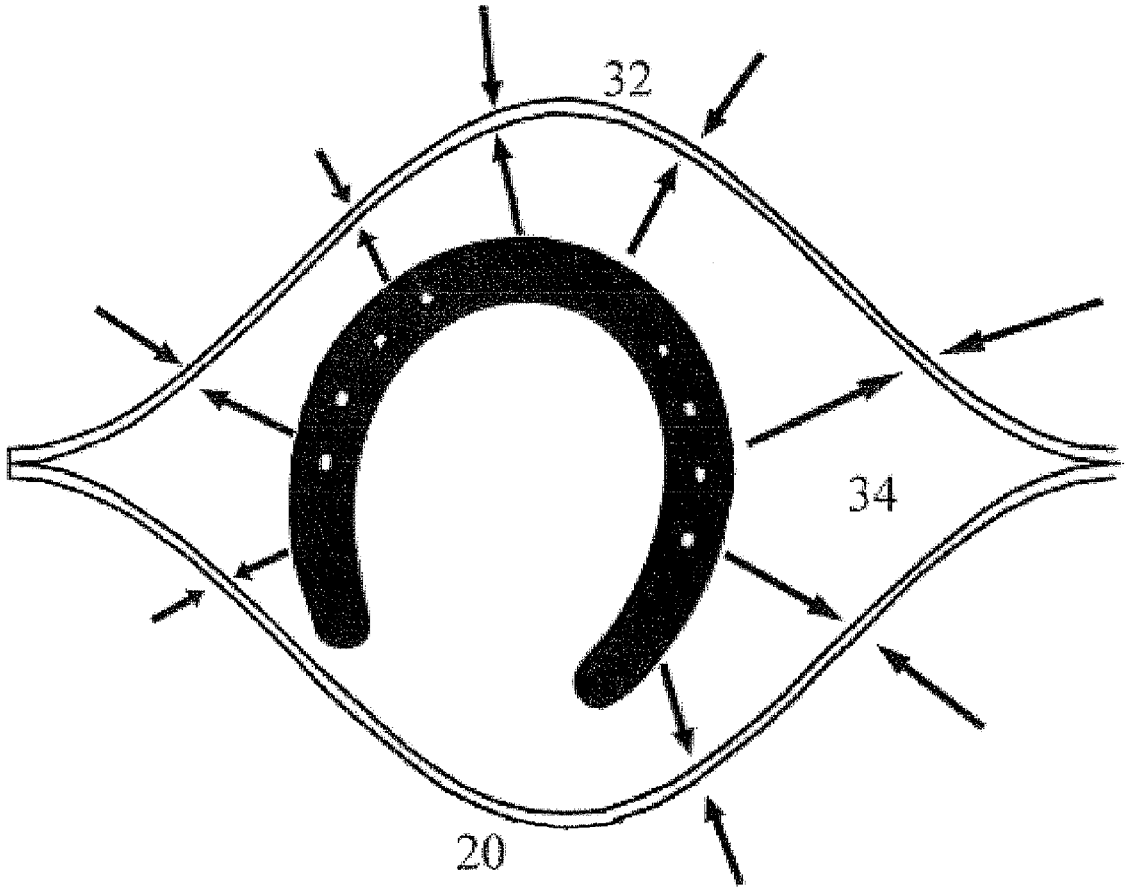
FIG. 9 is a schematic view illustrating the animal hoof (and optional horseshoe as illustrated) applying pressure laterally against the geocell walls and the opposing forces that the cell wall provides.

The lateral forces in the cells caused by the hoof FIGS. 8 and 9 are counteracted by opposing forces applied by the cell walls. This action limits displacement and prevents mixing action in the gravel which prevents mud and retains the compacted aggregate in the cells.

Optional spaced-apart openings 44 may be added to geocell sidewall 32 as illustrated. The openings allow water or moisture to escape laterally as well as through the normal vertical drainage to help prevent pooling on the upper aggregate surface.

The illustrated embodiments are only examples of the present invention and, therefore, are non-limitive. It is to be understood that many changes in the particular structure, materials, and features of the invention may be made without departing from the spirit and scope of the invention. Therefore, it is the Applicant's intention that his patent rights not be limited by the particular embodiments illustrated and described herein, but rather by the following claims interpreted according to accepted doctrines of claim interpretation, including the Doctrine of Equivalents and Reversal of Parts.

What is claimed is:

1. A method of remediating existing mud and preventing future mud in an area where animals with hooves are sheltered or exercised wherein the area contains an unpaved ground having soil and/or mud; the method comprising:

providing a layer of networked geocells, wherein each geocell comprises a generally uniform, thin, flexible sidewall forming an opening of a size larger than an animal hoof, the geocell layer approximating a honeycomb shape where adjacent geocells are connected and the overall networked geocell layer has an upper edge and a lower edge; and wherein each geocell opening is almond-shaped and defined by two end points and two mid-section points;

forming a new surface over the existing soil and/or mud by placing the layer of geocells on top of the soil;

filling the openings of the honeycomb shaped geocell layer with aggregate matter and compacting the aggregate matter into the geocell layer; and allowing at least one animal to stand or walk atop of and distributing weight of the animal through one of its hooves onto or above an aggregate matter-filled geocell of the aggregate covered geocell layer causing downward forces of the animal hoof to radiate laterally and outwardly to the geocell sidewall thereby limiting vertical displacement of each animal hoof and preventing mixing action of the aggregate matter with wet soil by counteracting lateral forces from the animal hoof within each geocell by its corresponding sidewall through cellular confinement;

whereby the geocell layer prevents mud through the distribution of weight applied to the soil by hooves over a greater area, limiting displacement of aggregate matter within the individual geocell sidewall through cellular confinement, and preventing wet soil from mixing with the aggregate matter.

2. The method according to claim 1 wherein each geocell side-wall defines a plurality of perforations.

3. The method according to claim 1 wherein the animal is a horse.

4. The method according to claim 1 wherein the method further comprises first applying a layer of geotextile barrier on top of a soil surface and laying the networked geocells atop of the geotextile barrier and wherein the lower edge of the honeycomb shaped geocell layer contacts the geotextile barrier.

5. The method according to claim 1 wherein the method further comprises adding an aggregate layer on top of the aggregate-filled geocell layer.

6. The method according to claim 5 wherein the aggregate layer is approximately ½ to 4 inches thick.

7. The method according to claim 6 wherein the aggregate layer is approximately 2 inches thick.

8. A method of remediating existing mud and preventing future mud in an area where animals with hooves are sheltered or exercised wherein the area contains an unpaved ground having soil and/or mud; the method comprising:

applying a layer of geotextile barrier on top of an existing soil surface;

providing a layer of networked geocells, wherein each geocell comprises a generally uniform, thin, flexible sidewall forming generally almond-shaped openings, each said opening defined by two end points and two mid-section points and being larger than an animal hoof, the layer of geocells approximating a honeycomb shape wherein adjacent geocells are adhered to each other at respective end-points and mid-section points; said layer of geocells having an upper edge and lower edge;

forming a new surface of the existing soil by placing the layer of geocells on top of the geotextile barrier wherein the lower edge of the honeycomb shaped geocell layer contacts the geotextile barrier;

filling the openings of the honeycomb shaped geocell layer with aggregate matter and compacting the aggregate matter into the geocell layer;

adding an aggregate layer on top of the filled geocell layer; and allowing at least one animal to stand or walk on top of and to distribute its weight through one of its hooves onto the aggregate layer, above an aggregate-filled geocell of the aggregate covered geocell layer causing downward forces of the animal hoof to radiate laterally and outwardly to the geocell sidewall thereby limiting vertical displacement of each animal hoof and preventing mixing action of the aggregate layer with wet soil by counteracting lateral forces from the animal hoof within each geocell by its corresponding sidewall through cellular confinement;

whereby the geocell layer prevents mud through the distribution of weight applied to the soil by the animal's hooves over a greater area of the new surface, limiting displacement of the aggregate layer and aggregate matter within each individual geocell sidewall through cellular confinement, and preventing wet soil from mixing with the aggregate layer.

9. The method of claim 8 wherein each geocell sidewall defines a plurality of perforations.

* * * * *